US005809622A

United States Patent [19]

Yaguramaki

[11] Patent Number: 5,809,622

[45] Date of Patent: Sep. 22, 1998

[54] AUTOLOCK SLIDER FOR SLIDE FASTENER

[75] Inventor: Iwao Yaguramaki, Toyama-ken, Japan

[73] Assignee: YKK Corporation, Tokyo, Japan

[21] Appl. No.: 900,857

[22] Filed: Jul. 25, 1997

[30] Foreign Application Priority Data

Jul. 31, 1996 [JP] Japan ..... 8-201457

[51] Int. Cl.[6] ..... A44B 19/00

[52] U.S. Cl. ..... 24/421; 24/419; 24/424

[58] Field of Search ..... 24/421, 424, 423, 24/425, 419, 429, 433, 436

[56] References Cited

U.S. PATENT DOCUMENTS

| | | | |
|---|---|---|---|
| 4,422,220 | 12/1983 | Oda | 24/421 |
| 5,152,036 | 10/1992 | Oda et al. | 24/424 |
| 5,419,019 | 5/1995 | Ida | 24/421 |
| 5,544,394 | 8/1996 | Yaguramaki | 24/424 |

FOREIGN PATENT DOCUMENTS

| | | | |
|---|---|---|---|
| 0978831 | 12/1964 | United Kingdom | 24/424 |

*Primary Examiner*—Victor N. Sakran
*Attorney, Agent, or Firm*—Hill & Simpson

[57] ABSTRACT

In an autolock slider, an upper wing of a slider body has a concave pivot-projection-receiving recess extending into a fastener-element guide post, a locking-pawl-insertion hole off the guide post, and an attachment post standing on the guide post. A locking lever having at its front and rear ends a pivot projection and a locking pawl, respectively, is supported on the upper wing with a rounded end of the pivot projection loosely received in the concave recess and the locking pawl inserted in the locking-pawl-insertion hole. A spring is accommodated in a spring-accommodating portion formed on the upper side of the attachment post, resiliently touching the upper side of the lever. The attachment post has a tongue for restricting upward movement of the pivot projection.

9 Claims, 6 Drawing Sheets

AUTOLOCK SLIDER FOR SLIDE FASTENER

BACKGROUND OF THE INVENTION

1. Field of the Invention

This invention relates to an autolock slider, for an concealed-type and an ordinary-type slide fastener, in which a locking lever having a locking pawl at one end is supported in a guide post of a slider body for vertical and pivotal movement.

2. Description of the Related Art

Japanese Utility Model Laid-Open Publication No. Hei 7-16608 discloses a concealed-type autolock slide fastener slider in which, as shown in FIG. 9 of the accompanying drawings, a locking lever 2' having at one end a locking pawl 18' and at the other end a pivot projection 19' is pivotally placed on an upper wing 8' of a slider body 1' with the pivot projection 19' simply received vertically in a pivot-projection-receiving recess 13' in an attachment post 11' standing on a guide post 7' of the slider body 1' while a spring 3' is fixed to the slider body 1' and resiliently touches the upper surface of the locking lever 2'.

Further, Japanese Utility Model Publication No. Sho 56-37607 discloses an ordinary-type autolock slide fastener slider in which, as shown in FIG. 10 of the accompanying drawings, a pivot projection 19' extending from one end of a locking lever 2' is received horizontally in a pivot-projection-receiving recess 13' formed in the upper surface of a guide post 7' of the slider body 1' with its rounded end confronting a rounded corner at the inner edge of a cover 30', which is mounted on the slider body 1', with a small gap in such a manner that upward movement of the locking projection 19' is restricted.

In the conventional concealed-type autolock slider disclosed in the first-named publication, since the pivot projection of the locking lever 2' is received in the pivot-projection-receiving recess 13' formed in the attachment post 11' standing on the guide post 7' of the slider body 1', the whole slider body necessarily has a large thickness, which would occasionally play as an obstruction during use. Also since the pivot-projection-receiving recess 13' has no means for restricting the upward a movement of the pivot projection 19', there would be a fear that the pivot projection 19' might be remove off the pivot-projection-receiving recess 13' depending on the shape and/or resiliency of the spring 3'.

In the conventional ordinary-type autolock slide fastener slider disclosed in the second-named publication, since the pivotal movement of the horizontal pivot projection 19' of the locking lever 2' is too much restricted by the corner of the inner edge of the cover 30', a smooth locking/unlocking action of the locking lever 2' is difficult to achieve. The locking mechanism of this slider is not suitable for a concealed-type autolock slide fastener slider.

SUMMARY OF THE INVENTION

It is therefore a first object of this invention to provide an autolock slide fastener slider which is small in whole size and thickness, neat in appearance and hence useful particularly for a concealed-type slider in which a pivotal end of a locking mechanism is loosely held so as to secure a smooth and reliable locking function.

A second object of the invention is to provide an autolock slide fastener slider in which a slider body is specified in shape to have a reduced thickness so that the slider is suitable for a concealed-type slider and an ordinary-type slider as well.

A third object of the invention is to provide an autolock slide fastener slider in which the form of connection between the locking lever and the slider body is specified so as to secure a smooth action of the locking lever and so as to facilitate assembling, thus realizing automatic assembling.

A fourth object of the invention is to provide an autolock slide fastener slider in which the shape of the slider body is specified in accommodation of a spring so as to make the slider suitable particularly for a concealed-type slider and so as to facilitate assembling, thus enabling automatic assembling.

A fifth object of the invention is to provide an autolock slide fastener slider in which the slider body and the cover are specified in shape so as to make the slider suitable particularly for an ordinary-type slider and so as to facilitate assembling, thus enabling automatic assembling.

According to a first aspect of the invention, there is provided an autolock slider for a slide fastener, comprising: a slider body, a locking lever, restricting means, a spring, and a pull tab. The slider body composed of upper and lower wings and a guide post standing on a front end of the lower wing so as to define a fastener-element guide channel between the upper and lower wings. The upper wing has a pivot-projection-receiving recess extending into the guide post and a locking-pawl-insertion hole disposed off the guide post and communicating with the fastener-element guide channel. The pivot-projection-receiving recess has a concave bottom. The locking lever has a locking pawl at one end and a pivot projection at the other end and is supported on the upper wing with the locking pawl inserted in the locking-pawl-insertion hole and with a rounded end of the pivot projection pivotally received in the pivot-projection-receiving recess. The restricting means are disposed above the pivot-projection-receiving recess for restricting upward sliding movement of the pivot projection. The spring acts on the locking lever in such a manner that the locking pawl is urged to normally project into the fastener-element guide channel. The pull tab has an axle disposed between the upper wing and the locking lever for pulling the locking lever away from the upper wing against the resiliency of the spring so as to retract the locking pawl from the fastener-element guide channel.

According to a second aspect of the invention, the pivot-projection-receiving recess is disposed below the level of an upper surface of the upper wing.

According to a third aspect of the invention, the autolock slider further includes an attachment post standing on a front end of the upper wing, the restricting means is a tongue projecting from the attachment post toward the pivot-projection-receiving recess.

According to a fourth aspect of the invention, the tongue is disposed on an inner surface of a guide recess formed in a front wall of the attachment post.

According to a fifth aspect of the invention, the tongue extends obliquely from the attachment post, the locking lever has at a position toward the pivot projection a flat step portion engageable with the tongue.

According to a sixth aspect of the invention, the autolock slider further includes a spring-accommodating portion disposed on an upper portion of the attachment post, the spring being accommodated in the spring-accommodating portion and resiliently touching an upper side of the locking lever.

According to a seventh aspect of the invention, a front end of the spring is covered by the front wall of the attachment post.

According to an eighth aspect of the invention, the autolock slider further includes a box-shaped cover fixed to the attachment post, the attachment post being a double form composed of front and rear attachment posts, the restricting means being disposed on an inner side of the front attachment post, the and spring being fixed to an upper portion of the front attachment post and resiliently touching the locking lever.

According to an ninth aspect of the invention, the autolock slider further includes an arcuate-top box-shaped cover fixed to the attachment post, the attachment post being a double form composed of front and rear attachment posts, the and spring being disposed in the arcuate-top box-shaped cover and resiliently touching a top of the locking lever.

DETAILED DESCRIPTION OF THE PREFERRED EMBODIMENT

Preferred embodiments of an autolock slide fastener slider of this invention will now be described in detail with reference to the accompanying drawings.

Figure 9:
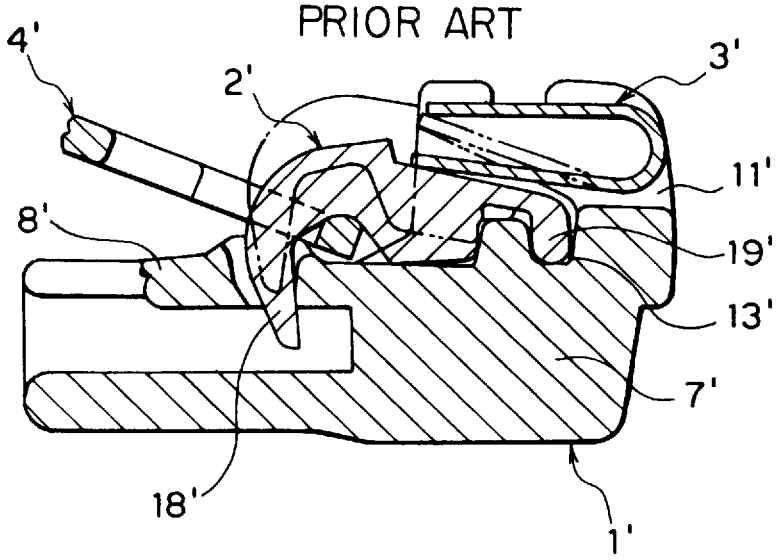
FIG. 9 PRIOR ART
FIG. 9 is a longitudinal cross-sectional view of a conventional concealed-type automatic slide fastener slider, showing the slider when locked.
Figure 10:
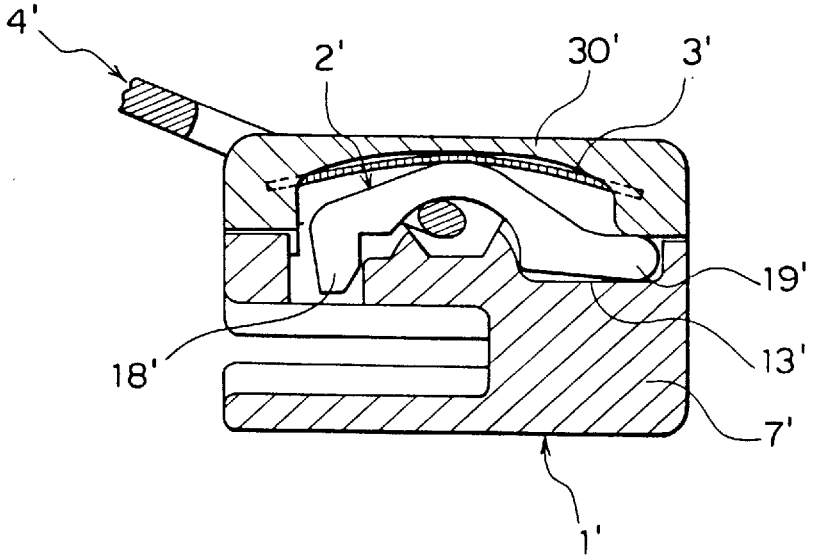
FIG. 10 PRIOR ART
FIG. 10 is a longitudinal cross-sectional view of a conventional ordinary-type autolock slide fastener slider, showing the slider when unlocked for sliding.

The slider of this invention is an improvement of the conventional concealed-type autolock slide fastener slider of FIG. 9. As shown in FIGS. 1 through 5, the concealed-type slide fastener slider generally comprises a slider body 1, a locking lever 2, a spring 3, a pull tab 4 and a connecting ring 5; all of these members except the spring 3 are molded preferably of metal such as aluminum alloy or zinc alloy by di-casting.

The slider body 1 is composed of upper and lower wings 8, 6 and a fastener-element guide post 7 standing on a front end of the lower wing 6 so as to define a Y-shaped fastener-element guide channel 26 between the upper and lower wings 8, 6. The upper wing 8 has a locking-lever-insertion hole 10 in a position near the convergent point of the Y-shaped fastener-element guide channel 26. An attachment post 11 stands on a top of the guide post 7. Between the attachment post 11 and the locking-lever-insertion hole 10, a part of valley-like slopes is formed to facilitate floating the locking lever 2 off the upper wing 8 by the action of the pull tab 4.

The attachment post 11 has a generally C-shaped spring-accommodating portion 12 whose front side is closed by a front wall 14. Part of the locking lever 2 is to be inserted in the spring-accommmodating portion 12. The spring-accommodating portion 12 has a concave pivot-projection-receiving recess 13 in its bottom, i.e., the guide post 7. The attachment post 11 has on the front wall 14 a stopper 15 for restricting movement of the locking lever 2. The stopper 15 is in the form of a tongue 16 projecting inwardly from the front wall 14 toward the pivot-engaging recess 13 and engageable with a flat step portion 20 formed in the locking lever 2 at its upper side toward the pivot projection 19 having a rounded end so that a pivot projection 19 (described below) of the locking lever 2 is prevented from removing off the pivot-projection-receiving recess 13 and.

The attachment post 11 has a pair of cutouts 33 at opposite sides of the spring-accommodating portion 12 in which cutouts part of the spring 3 is fixedly fitted. The front end of the spring 3 is covered and protected by the front wall 14.

The locking lever 2 has at one end a locking pawl 18 bent by a right angle and at the other end the pivot projection 19 extending in the same direction as the locking pawl 18 and having a rounded end. The locking pawl 18 has an arcuate base through which the connecting ring 5 of the pull tab 4 is inserted. The flat step portion 20 horizontally disposed on the upper side of the locking lever 2 may be substantially flush with the upper surface of the attachment post 11 as shown in FIG. 4, making the slider neat in appearance.

The spring 3 is in the form of a U-bent leaf spring with its upper part 21 fitted in the cutouts 33 of the attachment post 11 and larger in width than its lower part 22 whose free end resilently touches the upper surface of the locking lever 2. The pull tab 4 has a grip 23 at one end and a spanner-wrench-shaped connecting portion 24 to which the connecting ring 5 is connected. The connecting ring 5 has a generally triangular shape having at one apex an axle 25 to be threaded through the curved portion of the locking lever 2.

Figure 1:
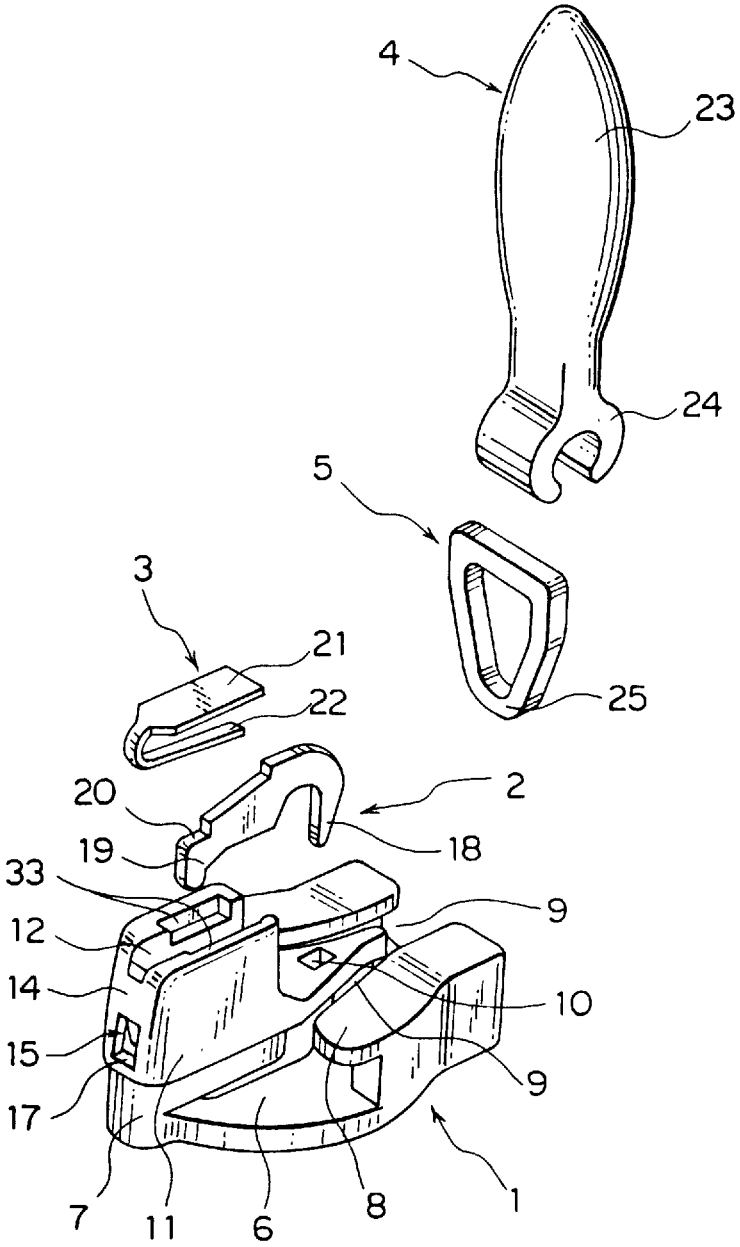
FIG. 1 is an exploded perspective view of a concealed-type autolock slide fastener slider according to a first embodiment of this invention.
Figure 2:
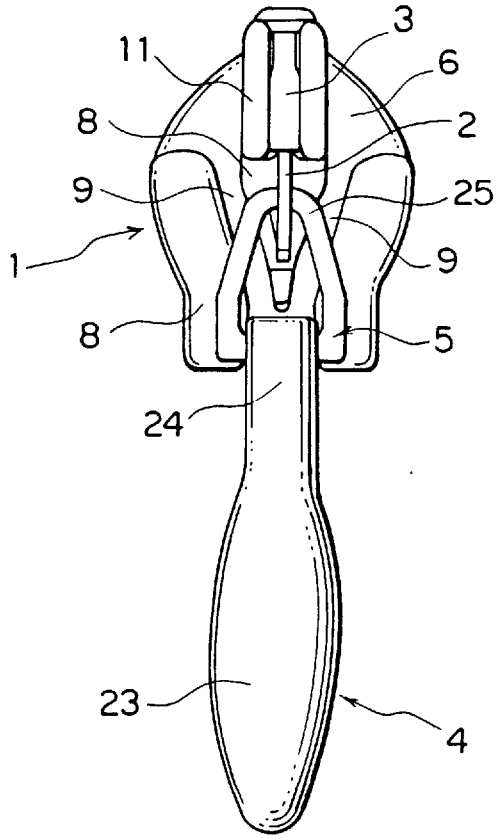
FIG. 2 is a top plan view of the slider of the first embodiment, showing the slider in an assembled form.
Figure 3:
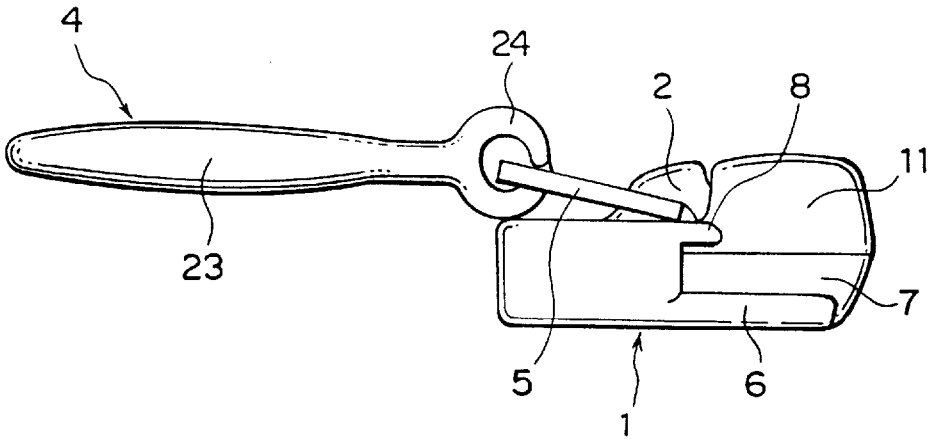
FIG. 3 is a side view of the slider of FIG. 2.

For assembling the slider, with the axle 25 of the connecting ring 5, which is connected to the pull tab 4, placed between the locking-pawl-insertion hole 10 and the attachment post 11, the locking lever 2 is placed over the axle 25 in the spring-accommodating portion 12 of the attachment post 11 with the pivot projection 19 loosely received in the pivot-projection-receiving recess 13 for pivotal movement and with the locking pawl 18 inserted in the locking-pawl-insertion hole 10. Then the tongue 16 which is disposed on an inner surface of a guide recess 17 formed in the front wall 14 of the attachment post 11 by a molding punch in such a manner that the tongue 16 projects toward the step portion 20 of the locking lever 2, and the spring 3 is placed in the spring-accommodating portion 12 with the upper part 21 fitted in the cutouts 33 of the upper surface of the attachment post 11 and with the free end of the lower part 22 resiliently touching the upper surface of the locking lever 2. Finally, the attaching post 11 is clenched at opposite sides of the cutouts 33 to secure the spring 3 as shown in FIG. 2. The foregoing assembling procedure may be automated, and the illustrated arrangement of the slider is intended for automatic assembling.

Figure 4:
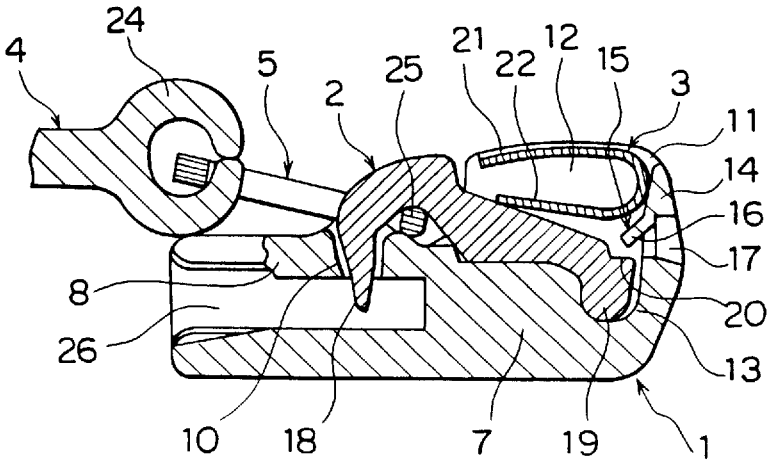
FIG. 4 is a longitudinal cross-sectional view of the slider of FIG. 2, showing the slider when locked.
Figure 5:
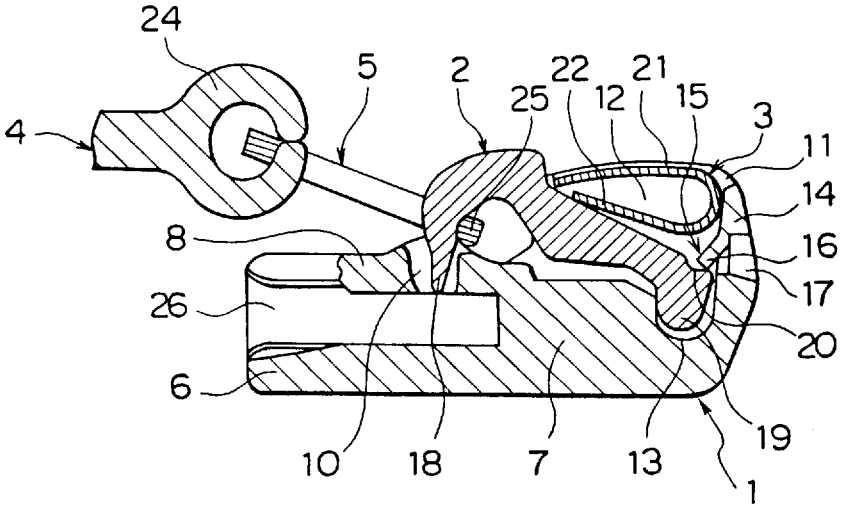
FIG. 5 is a longitudinal cross-sectional view of the slider similar to FIG. 4, but showing the slider when unlocked for sliding.

In operation, if the axle 25 of the connecting ring 5 is raised along the slopes on the upper wing 8 by pulling the pull tab 4, the locking lever 2 is pivotally moved clockwise about the pivot projection 19 from the slider-locking position of FIG. 4, in which the locking pawl 18 projects into the fastener-element guide channel 26, to the slider-unlocking position of FIG. 5, in which the locking pawl 18 is retracted from the fastener-element guide channel 26, against the resiliency of the spring 3, until the step portion 20 of the locking lever 2 is brought into engagement with the tongue 16. As a result, the slider is free to move along the opposed fastener stringers. If the pull tab 4 is released, the locking pawl 18 automatically projects into the fastener-element guide channel 26 under the resiliency of the spring 3 to engage with the fastener element rows, thereby locking the slider.

Figure 6:
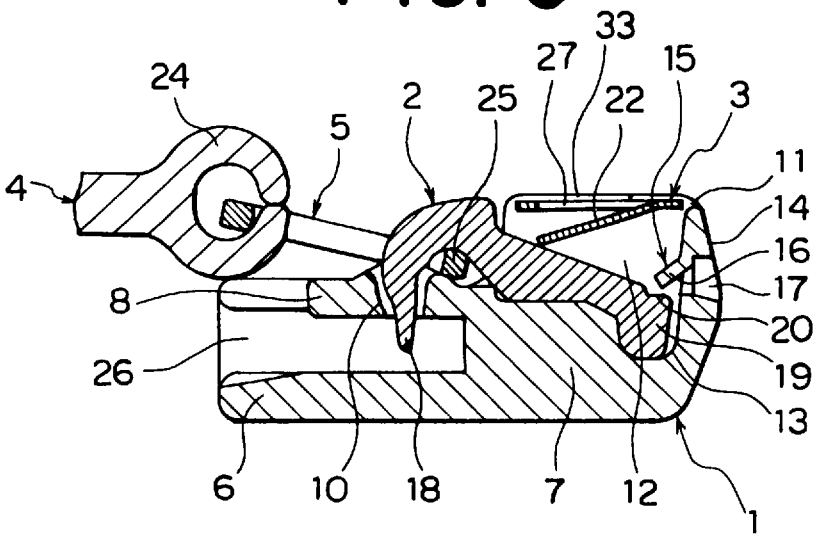
FIG. 6 is a longitudinal cross-sectional view of a modification of the slider of the first embodiment, showing the modified slider when locked.

FIG. 6 shows a concealed-type autolock slide fastener slider, which is a modification of the slider of the first embodiment. This modified slider is identical in construction with the slider of the first embodiment except the form of a spring 3 to be fixed to the attachment post 11. Specifically, the spring 3 is in the form of a rectangular leaf spring having a part defined by an elongate central C-shaped cut to form a downwardly bent resilient tongue 22 and a pair of opposite attaching margins 27 outside the resilient tongue 22. In assembling, the attaching margins 27 are fitted in and secured to the cutouts 33 of the attachment post 11, while the resilient tongue 22 resiliently touches the upper surface of the locking lever 2.

Figure 7:
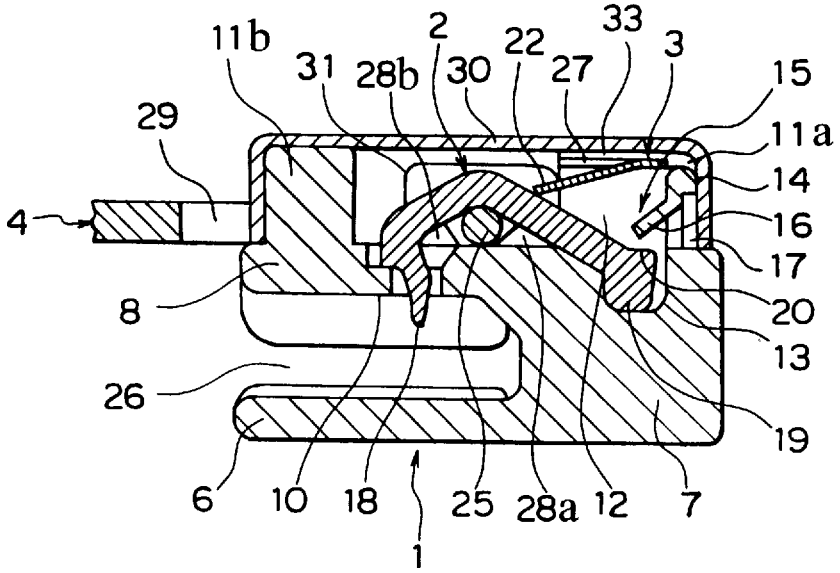
FIG. 7 is a longitudinal cross-sectional view of an ordinary-type autolock slide fastener slider according to a second embodiment, showing the slider when locked.
Figure 8:
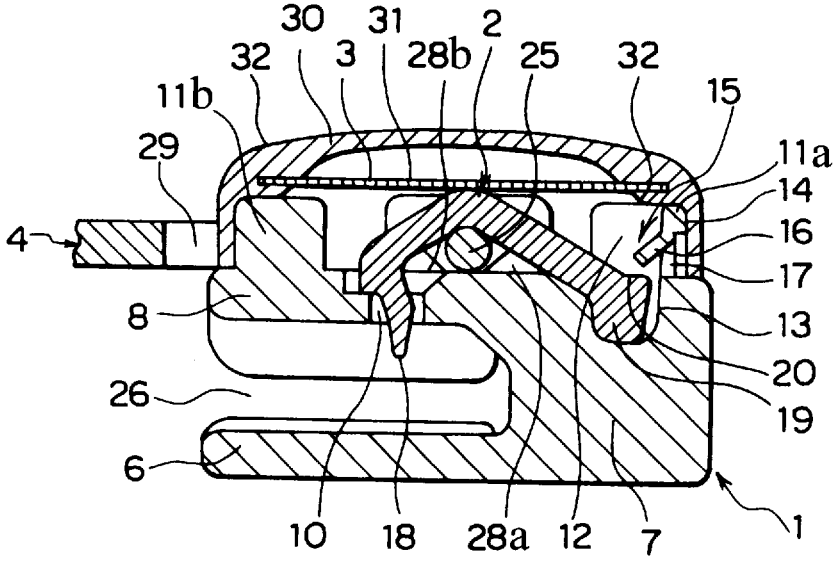
FIG. 8 is a longitudinal cross-sectional view of a modification of the slider of the second embodiment, showing the modified slider when locked.

FIGS. 7 and 8 show ordinary-type autolock slide fastener sliders. In the slider of FIG. 7, the attachment post 11 is a double form composed of front and rear attachment posts 11*a*, 11*b*". The front attachment post 11 has a generally C-shaped spring-accommodating portion 12 whose front side is closed by a front wall 14. Part of the locking lever 2 is to be inserted in the spring-accommodating portion 12. The spring-accommodating portion 12 has a pivot-projection-receiving recess 13 in its bottom, i.e., the guide post 7. The rear attachment post 11*b*' has a rectangular cross section.

The upper wing 8 has a locking-lever-insertion hole 10 at the part near the rear attachment post 11*b*'. Between the front attachment post 11 and a locking-lever-insertion hole 10, a pair of confronting protuberances 28*a*, 28*b*" is formed. On inner surface of a guide recess 17 formed in the front wall 14 of the front attachment post 11*a*, a tongue 16 is disposed as a stopper 15 by a molding punch in such a manner that the tongue 16 projects toward the pivot-projection-receiving recess 13. The front attachment post 11 has a pair of cutout 33 at opposite sides of the spring-accommodating portion 12 in which cutouts 33 the spring 3 is fixedly fitted.

The locking lever 2 is bent in generally C shape having at one end a locking pawl 18 and at the other end a pivot projection 19 extending in the same direction as the locking pawl 18 and having a rounded end. The locking lever 2 further has a horizontal flat step portion 20 on its upper side off to the pivot projection 19. The pull tab 4 is in the form of a rectangular plate having an opening 29 formed off to one end so as to provide an axle 25. The spring 3 is in the form of a rectangular leaf spring having a part defined by two central longitudinal lines of cuts to form a downwardly bent elongate resilient tongue 22 and a pair of opposite attaching margins 27 outside the resilient tongue 22. The resilient tongue 22 resiliently touches the upper surface of the locking lever 2, and a pair of opposite attaching margins 27 is to be fitted in opposite side cutouts 33 of the attachment post 11*a*. A box-shaped cover 30 is attached so as to cover the front and rear attachment posts 11*a*, 11*b*" and has a pair of cutaways 31 on each of opposite side walls through which the axle 25 of the pull tab 4 is to be inserted.

For assembling the slider of FIG. 7, firstly, with the axle 25 of the pull tab 4, placed between the confronting protuberances 28*a*, 28*b*", the locking lever 2 is placed over the axle 25 in the spring-accommodating portion 12 of the front attachment post 11*a* with the pivot projection 19 loosely received in the concave pivot-projection-receiving recess 13 for pivotal movement and with the locking pawl 18 inserted in the locking-pawl-insertion hole 10. Then the tongue 16, which is disposed on inner surface of the guide recess 17 formed in the front wall 14 of the attachment post 11*a*, is formed as the stopper 15 by a molding punch in such a manner that the tongue 16 projects toward the step portion 20 of the locking lever 2, and the spring 3 is placed in the spring-accommodating portion 12 with the attaching margins 27 fitted in the cutouts 33 of the upper surface of the front attachment post 11*a* and with the free end of the resilient tongue 22 resiliently touching the upper surface of the locking lever 2. Finally, the front and rear attaching posts 11*a*, 11*b*" are covered by the cover 30, whereupon the cover 30 is secured to the front and rear attachment posts 11*a*, 11*b*" by clenching the side walls inwardly. Further, the cover 30 may be attached to the attached posts 11*a*, 11*b*" by a resilient engagement through an engaging portion.

In operation, if the axle 25 of the pull tab 4 is raised along the slopes on a pair of confronting protuberances 28*a*, 28*b*" by pulling the pull tab 4 forwardly or backwardly, in whichever direction, the locking lever 2 is pivotally moved clockwise about the pivot projection 19 from the slider-locking position shown in FIG. 7, in which the locking pawl 18 projects into the fastener-element guide channel 26, to a non-illustrated slider-unlocking position, in which the locking pawl 18 is retracted from the fastener-element guide channel 26, against the resiliency of the spring 3, until the step portion 20 of the locking lever 2 is brought into engagement with the tongue 16. As a result, the slider is free to move along the fastener stringers. If the pull tab 4 is released, the locking pawl 18 automatically projects into the fastener-element guide channel 26 under the resiliency of the spring 3 to engage with the fastener element rows, thereby locking the slider.

FIG. 8 shows a modification of the ordinary-type slider of FIG. 7. The slider of FIG. 8 is substantially identical in construction with the slider of FIG. 7 except that the spring 3 and the cover 30 are modified.

Specifically, the modified spring 3 is in the form of a mere rectangular leaf spring, and the modified cover 30 is in the form of an arcuate-top die-cast box having front and rear projections 32 to which opposite ends of the leaf spring 3 are to be attached . The cover 30 with the spring 3 mounted inside is attached to the front and rear attachment posts 11*a*, 11*b*" on the upper wing 8 of the slider body 1 to cover the attachment posts 11*a*, 11*b*" and the locking lever 2 as well, whereupon opposite side walls of the cover 30 are clenched against the front and rear attachment posts 11*a*, 11*b*". This slider can be locked and unlocked likewise the foregoing sliders.

The autolock slide fastener slider of this invention has the following advantageous results:

According to the autolock slider as described in claim 1, partly since the locking lever 2 has at one end a locking pawl 18 and at the other end a pivot projection 19 parallel to the locking pawl 18 and having a rounded end, and partly since the guide post 7 has in its upper surface a concave pivot-projection-receiving recess 13 in which the pivotal projection 19 is loosely received, the pivot projection 19 of the locking lever 2 can be smoothly pivotally moved in the pivot-projection-receiving recess 13.

Further, since the stopper 15 is disposed above the pivot-projection-receiving recess 13 so as to allow the pivot projection 19 to move vertically and pivotally to a certain extent in the pivot-projection-receiving recess 13 , it is possible to lock and unlock the slider smoothly and reliably; besides, since the pivot projection 19 is prevented from being removed off the pivot-projection-receiving recess 13 by the stopper 15 regardless of the use, it is possible to secure a reliable locking/unlocking operation for a long time.

According to the autolock slider as described in claim 2, since the upper end of the pivot-projection-receiving recess 13 is disposed below the upper surface of the upper wing 8, it is possible to reduce the whole slider in thickness, thereby achieving a neat finish of the slider and making the slider body free from being an obstruction during use particularly in a concealed-type slider.

According to the autolock slider as described in claim 3, since the stopper 15 is in the form of a tongue 16 formed on the attachment post 11 by a molding punch and projecting toward the pivot-projection-receiving recess 13, it is possible to manufacture the stopper 15 in a very simple manner, thus making the slider suitable for automatic assembling.

According to the autolock slider as described in claim 4, since the tongue 16 is disposed on an inner surface of a guide recess 17 formed in the front wall 14 of the attachment post 11, it is possible to form the tongue 16 simply and precisely using a molding punch as guided by the guide recess 17.

According to the autolock slider as described in claim 5, since the tongue 16 projects obliquely from the attachment post 11 and is touchable with the flat step portion 20 of the locking lever 2, it is possible to maintain an effective positional relationship between the tongue 16 and the locking lever 2 so that movement of the locking lever 2 can be permitted and restricted reliably.

According to the autolock slider as described in claim 6, since the spring-accommodating portion 12 is disposed on the attachment post 11 and accommodates the spring 3 resiliently touching the upper surface of the locking lever 2, it is possible to make the slider smaller in thickness and neat in appearance and to secure an accurate locking/unlocking action of the locking lever 2 as well as to facilitate automatic assembling of a concealed-type slider.

According to the autolock slider as described in 7, since the spring 3 is covered at its front end by the front wall 14 of the attachment post 11, it is possible to protect the spring 3 and hence to secure adequate resiliency of the spring 3 for a long time.

According to the autolock slider as described in claims 8 and 9, partly since the attachment post 11 is in a double form standing on the upper wing 8 with the stopper 15 projecting inwardly in the front attachment post 11*a*, and partly since the box-shaped cover 30 having a flat top or an arcuate top is fixedly attached to the front and rear attachment posts 11, 11', in such a manner that the spring 3 supported by the upper portion of the front attachment post 11 or by the arcuate-top cover resiliently touches the front part of the locking lever 2 or the top of the locking lever 2, it is possible to make the slider smaller in thickness and neat in appearance and to secure an accurate locking/unlocking action of the locking lever 2 as well as to facilitate automatic assembling of an ordinary-type slider.

What is claimed is:

1. An autolock slider for a slide fastener, comprising:

(a) a slider body comprised of upper and lower wings and a guide post standing on a front end of said lower wing so as to define a fastener-element guide channel between said upper and lower wings;

(b) said upper wing having a pivot-projection-receiving recess extending into said guide post and a locking-pawl-insertion hole disposed off said guide post and communicating with said fastener-element guide channel, said pivot-projection-receiving recess having a concave bottom;

(c) a locking lever having a locking pawl at one end and a pivot projection at the other end and supported on said upper wing with said locking pawl inserted in said locking-pawl-insertion hole and with said pivot projection pivotally received in said pivot-projection-receiving recess, said pivot projection having a rounded end;

(d) restricting means disposed above said pivot-projection-receiving recess for restricting upward sliding movement of said pivot projection;

(e) a spring acting on said locking lever in such a manner that said locking pawl is urged to normally project into said fastener-element guide channel; and (f) a pull tab having an axle disposed between said upper wing and said locking lever for pulling said locking lever away from said upper wing against the resiliency of said spring so as to retract said locking pawl from said fastener-element guide channel.

2. An autolock slider according to claim 1, wherein said pivot-projection-receiving recess is disposed below the level of an upper surface of said upper wing.

3. An autolock slider according to claim 1, further including an attachment post standing on a front end of said upper wing, said restricting means being a tongue projecting from said attachment post toward said pivot-projection-receiving recess.

4. An autolock slider according to claim 3, wherein said tongue is disposed on an inner surface of a guide recess formed in a front wall of said attachment post.

5. An autolock slider according to claim 3, wherein said tongue extends obliquely from said attachment post, said locking lever having at a position toward said pivot projection a flat step portion engageable with said tongue.

6. An autolock slider according to claim 3, further including a spring-accommodating portion disposed on an upper portion of said attachment post, said spring being accommodated in said spring-accommodating portion and resiliently touching an upper side of said locking lever.

7. An autolock slider according to claim 6, wherein a front end of said spring is covered by said front wall of said attachment post.

8. An autolock slider according to claim 3, further including a box-shaped cover fixed to said attachment post, said attachment post being a double form disposed of front and rear attachment posts, said restricting means being disposed on an inner side of said front attachment post, said spring being fixed to an upper portion of said front attachment post and resiliently touching said locking lever.

9. An autolock slider according to claim 3, further including an arcuate-top box-shaped cover fixed to said attachment post, said attachment post being a double form composed of front and rear attachment posts, said spring being disposed in said arcuate-top box-shaped cover and resiliently touching a top of said locking lever.

* * * * *

UNITED STATES PATENT AND TRADEMARK OFFICE

CERTIFICATE OF CORRECTION

PATENT NO. : 5,809,622

DATED : September 22, 1998

INVENTOR(S) : Yaguramaki

It is certified that error appears in the above-identified patent and that said Letters Patent is hereby corrected as shown below:

On the title page, under item [56], insert the following:

FOREIGN PATENT OR PUBLISHED FOREIGN PATENT APPLICATION

| | | DOCUMENT NUMBER | | | | | | | PUBLICATION DATE | COUNTRY OR PATENT OFFICE | LASS | UBCLASS | TRANSLATION YES | TRANSLATION NO |
|---|---|---|---|---|---|---|---|---|---|---|---|---|---|---|
| | | GB | 97 | 8 | 8 | 3 | 1 | A | 12/23/64 | United Kingdom | | | | |
| | | CH | 65 | 6 | 2 | 9 | 3 | A | 06/30/86 | Switzerland | | | | |
| | | EP | 64 | 0 | 3 | 0 | 0 | A | 03/01/95 | Europe | | | | |
| | | | | | | | | | | | | | | |

Signed and Sealed this

Twenty-third Day of March, 1999

*Attest:*

Q. TODD DICKINSON

*Attesting Officer*

*Acting Commissioner of Patents and Trademarks*